US011723140B2

(12) United States Patent
Timpson et al.

(10) Patent No.: US 11,723,140 B2
(45) **Date of Patent: *Aug. 8, 2023**

(54) PLASMA FIELD FARADAY CAGE SYSTEM

(71) Applicant: HONEYWELL FEDERAL MANUFACTURING & TECHNOLOGIES, LLC, Kansas City, MO (US)

(72) Inventors: Erik Joseph Timpson, Olathe, KS (US); Joseph Ambrose Wolf, Olathe, KS (US)

(73) Assignee: HONEYWELL FEDERAL MANUFACTURINGS TECHNOLOGIES, LLC, Kansas City, MO (US)

( * ) Notice: Subject to any disclaimer, the term of this patent is extended or adjusted under 35 U.S.C. 154(b) by 124 days.

This patent is subject to a terminal disclaimer.

(21) Appl. No.: 17/498,789

(22) Filed: Oct. 12, 2021

(65) Prior Publication Data

US 2022/0086999 A1 Mar. 17, 2022

Related U.S. Application Data

(63) Continuation of application No. 17/001,112, filed on Aug. 24, 2020, now Pat. No. 11,291,101.

(51) Int. Cl.
*H05G 2/00* (2006.01)

(52) U.S. Cl.
CPC ..... *H05G 2/008* (2013.01)

(58) Field of Classification Search
CPC ..... H05G 2/008
USPC ..... 250/423 P
See application file for complete search history.

(56) References Cited

U.S. PATENT DOCUMENTS

| | | | | |
|---|---|---|---|---|
| 11,291,101 | B2 * | 3/2022 | Timpson | H05G 2/008 |
| 2010/0002353 | A1 * | 1/2010 | Barinov | H05F 1/00 361/225 |

* cited by examiner

*Primary Examiner* — Michael Maskell
(74) *Attorney, Agent, or Firm* — Hovey Williams LLP

(57) ABSTRACT

A system for creating a plasma field Faraday cage around a structure, the system comprising a plurality of lasers spaced apart from each other, each laser being configured to transmit an electromagnetic energy beam to a focal point of an atmosphere region, each electromagnetic energy beam having an amount of energy less than an amount of energy required to ionize air, the electromagnetic energy beams intersecting at the focal point such that the electromagnetic energy beams cooperatively ionize the air at the focal point to block electromagnetic radiation from passing through the focal point.

19 Claims, 8 Drawing Sheets

PLASMA FIELD FARADAY CAGE SYSTEM

RELATED APPLICATIONS

The present patent application is a continuation claiming priority benefit, with regard to all common subject matter, to U.S. patent application Ser. No. 17/001,112, entitled "PLASMA FIELD FARADAY CAGE SYSTEM", filed Aug. 24, 2020. The earlier-filed patent application is hereby incorporated by reference in its entirety into the present application.

GOVERNMENT INTERESTS

This invention was made with Government support under Contract No.: DE-NA-0002839 awarded by the United States Department of Energy/National Nuclear Security Administration. The Government has certain rights in the invention.

BACKGROUND

Faraday cages used for blocking electromagnetic signals and electromagnetic energy from reaching facilities, electronic devices, and electrical equipment are solid metal enclosures. The enclosures are costly, rigid, and unadaptable to changing needs and operating conditions. The enclosures also require special doors to provide ingress and egress while maintaining signal-blocking integrity.

SUMMARY

Embodiments of the invention solve the above-mentioned problems and other problems and provide a distinct advancement in the art of Faraday cage systems. More particularly, the invention provides systems for creating Faraday cages via ionized air.

An embodiment of the invention is a plasma field Faraday cage system broadly comprising a number of lasers, a number of motors, and a control system. The plasma field Faraday cage system blocks unwanted electromagnetic signals from reaching a facility.

The lasers are substantially similar, so only one laser will be described in detail. The laser is configured to transmit an electromagnetic energy beam to a focal point of an area surrounding the facility. The electromagnetic energy beam may have an amount of energy less than an amount of energy required to ionize air such that the electromagnetic energy beam cannot ionize air by itself.

The lasers are spaced apart from each other and cooperatively configured to transmit electromagnetic energy beams to intersect at the focal point. The electromagnetic energy beams have enough energy collectively to ionize the air at the focal point. The lasers may sweep across the atmosphere region via the motors to create a rasterizing effect.

The motors are substantially similar to each other so only one motor will be described in detail. The motor is drivably connected to the laser such that the motor is configured to rotate, pivot, and/or moves the laser. In one embodiment, two or more motors are drivably connected to each laser such that the lasers can be aimed across a range of azimuth and altitude angles.

The control system includes a transceiver and a controller. the transceiver receives incoming signals and other electromagnetic waves. The transceiver may also outwardly transmit signals from the control system or from electrical equipment related to the facility. The control system and/or the controller may also include processors, circuit boards, sensors, a memory, displays, inputs, and/or other electronic devices.

In use, the controller instructs the motors to aim the lasers at a first focal point of a region of atmosphere surrounding the facility. For example, the motors may rotate or pivot the lasers about several axes to achieve the correct azimuth angle and altitude angle.

The controller then instructs the lasers to transmit electromagnetic energy beams to the focal point so that the electromagnetic energy beams intersect at the focal point and cooperatively ionize the air at the focal point.

The controller then instructs the motors to move the lasers to redirect the electromagnetic energy beams to additional focal points over time. In this way, the lasers may rasterize across the atmosphere region to ionize air in an area of the atmosphere region.

The above-described system provides several advantages. For example, the system forms a plasma field Faraday cage around a facility without tremendous cost and material. The system does not require a physical enclosure and physical ingress and egress into and out of the physical enclosure. The system is dynamic and can accommodate many different sizes and shapes of buildings, structures, and equipment within the Faraday cage.

Another embodiment of the invention is a plasma field Faraday cage system broadly comprising a laser, a number of reflectors, a number of motors, and a control system. The plasma field Faraday cage system blocks unwanted electromagnetic signals from reaching an electronic device.

The laser is configured to transmit a plurality of electromagnetic energy beams to a focal point of an air region surrounding the electronic device. The electromagnetic energy beams may be portions of an initial electromagnetic energy beam divided by a beam splitter. Each electromagnetic energy beam individually has an amount of energy less than an amount of energy required to ionize air such that the electromagnetic energy beams cannot ionize air individually. The electromagnetic energy beams have enough energy collectively to ionize the air at the focal point.

The reflectors are substantially similar so only one reflector will be described in detail. The reflector redirects one of the electromagnetic energy beams at an angle toward the focal point. The reflector may be a mirror or other reflective or refractive device.

The motors are substantially similar so only one motor will be described in detail. The motor is drivably connected to the reflector such that the motor is configured to rotate, pivot, and/or translate the reflector. Another one of the motors may be drivably connected to a structure supporting the reflectors to further rotate, pivot, and/or translate the reflectors.

The control system includes a transceiver and a controller. The control system may also include processors, circuit boards, sensors, a memory, displays, inputs, and/or other electronic devices. The control system is substantially similar to the control system described above and thus will not be described in more detail.

In use, the controller instructs the motors to move the reflectors to a specific reflective position. This may require the motors to rotate or pivot the lasers reflectors about several axes to achieve the correct reflection angles and trajectories.

The controller then instructs the laser to transmit electromagnetic energy beams to the focal point via the reflectors so that the electromagnetic energy beams intersect at the focal point. The electromagnetic energy beams cooperatively ionize the air at the focal point via their combined energy.

The controller then instructs the motors to move the reflectors so as to redirect the electromagnetic energy beams to additional focal points over time. For example, the focal points may form a ring. The controller may also instruct the motor to move the reflectors to effectively move the ring, thereby forming a spherical surface of focal points protecting the electronic device.

Another embodiment of the invention is a plasma field Faraday cage system broadly comprising a laser, a lens, a number of motors, and a control system. The plasma field Faraday cage system may be used to block unwanted electromagnetic signals from reaching a facility.

The laser is configured to transmit an electromagnetic energy beam through the lens to a focal point of an atmosphere region surrounding the facility. The electromagnetic energy beam has enough energy when focused to ionize the air at the focal point.

The lens focuses the electromagnetic energy beam at the focal point. The lens may be a convex lens, a concave reflector, or the like.

The motors are substantially similar so only motor will be described in more detail. The motor is drivably connected to the lens such that the motor is configured to rotate, pivot, and/or move the lens. In one embodiment, each motor rotates the lens about a different axis perpendicular to the other axes.

The control system may include a transceiver and a controller. The control system may also include processors, circuit boards, sensors, a memory, displays, inputs, and/or other electronic devices. The control system may be substantially similar to the control systems described above and thus will not be described in more detail.

In use, the controller instructs the motors to move the lens to a specific refractive position. This may require the motors to rotate or pivot the lens about several axes to achieve the correct refractive angles.

The controller then instructs the laser to transmit the electromagnetic beam to the focal point via the lens so that the electromagnetic energy beam focuses at the focal point. The focused electromagnetic energy beam ionizes the air at the focal point.

The controller then instructs the motors to move the lens to redirect the electromagnetic energy beam to additional focal points over time. In this way, the laser ionizes an area of the atmosphere region.

Another embodiment of the invention is a plasma field Faraday cage system broadly comprising a laser, a lens, a control system, a support structure, and an airflow system. The plasma field Faraday cage system may be used to block unwanted electromagnetic signals from reaching electrical equipment.

The laser is configured to transmit an electromagnetic energy beam toward the lens. The electromagnetic energy beam may be unfocused until it is focused by the lens. The electromagnetic energy beam may have enough energy when focused to ionize the air at a focal ring encircling the electrical equipment.

The lens focuses the electromagnetic energy beam to the focal ring. To that end, the lens may have a convex donut shape.

The control system may include a transceiver and a controller. The control system may also include processors, circuit boards, sensors, a memory, displays, inputs, and/or other electronic devices. The control system may be substantially similar to the control systems described above and thus will not be described in more detail.

The support structure positions the electronic device within the atmosphere area to be ionized. The support structure may be a tower, electric pole, antenna, or the like. To that point, the support structure may elevate the electrical equipment above a ground surface, a building, or other structure.

The airflow system circulates air around the electrical equipment. The airflow system may be a system of fans, a wind tunnel, an HVAC system, or the like.

In use, the controller instructs the laser to transmit the electromagnetic energy beam toward and through the lens so that the electromagnetic energy beam focuses at the focal ring. The electromagnetic energy beam may ionize the air at the focal ring.

The controller then instructs the airflow system to circulate air around the electrical equipment. The ionized air at the focal ring thereby forms an ionized spherical surface encircling the electrical equipment.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
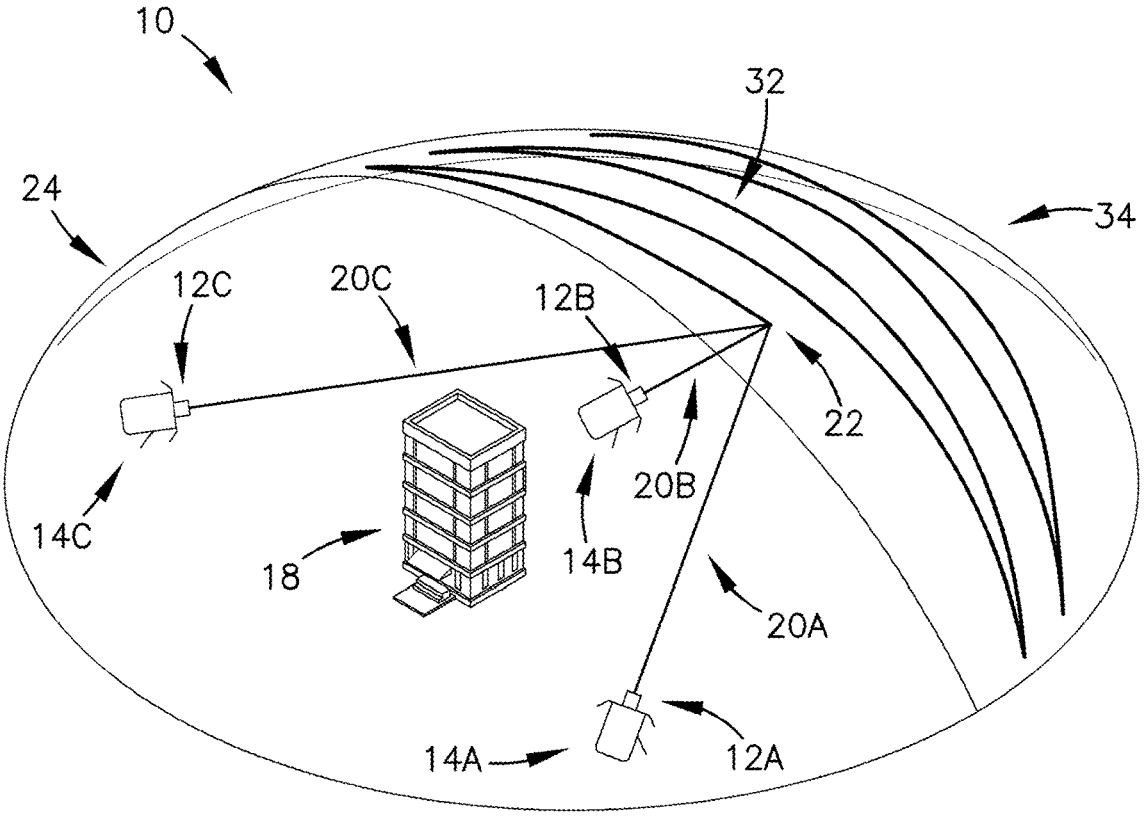
FIG. 1 is a perspective view of a plasma field Faraday cage system constructed in accordance with an embodiment of the invention.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current technology can include a variety of combinations and/or integrations of the embodiments described herein.

Figure 2:
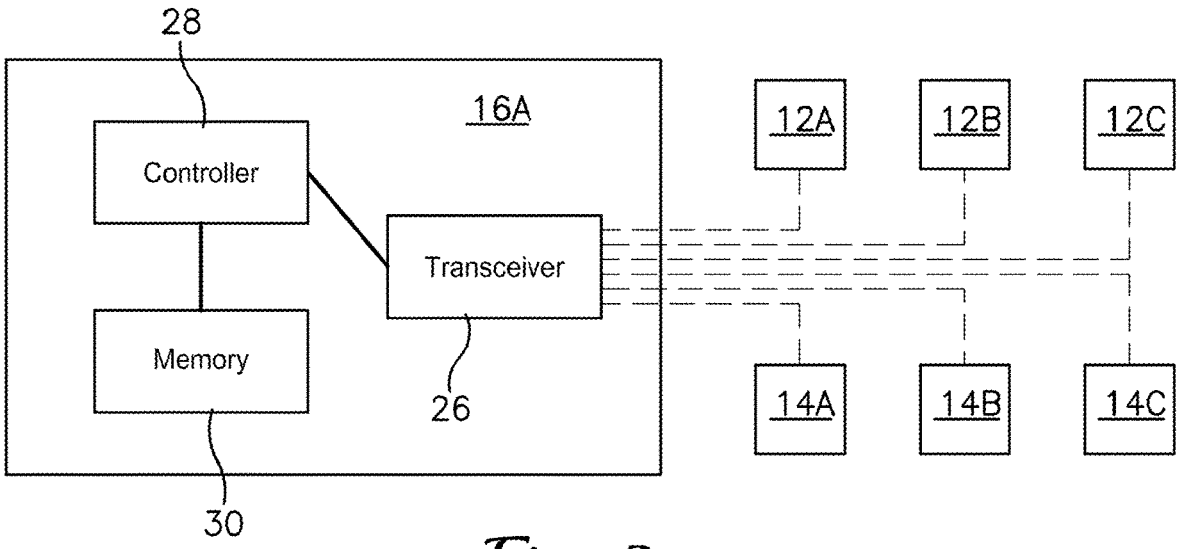
FIG. 2 is a schematic diagram of a control system of the plasma field Faraday cage system of FIG. 1.

Turning to FIGS. 1 and 2, a system 10 for creating a plasma field Faraday cage is illustrated. The system 10 broadly comprises a plurality of lasers 12A,B,C, a plurality of motors 14A,B,C, and a control system 16. The system 10 may be used to block unwanted electromagnetic signals from reaching an electronic device, electrical equipment, a structure, a facility, or the like. The system 10 is shown protecting a facility 18.

The lasers 12A,B,C are substantially similar, so only laser 12A will be described in detail. The laser 12A may be configured to transmit an electromagnetic energy beam 20A to a focal point 22 of an atmosphere region 24 (e.g., a dome, a hemisphere, a spherical surface, or the like). The electromagnetic energy beam 20A may have an amount of energy less than an amount of energy required to ionize air such that the electromagnetic energy beam 20A cannot ionize air by itself. The electromagnetic energy beams 20A,B,C may have enough energy collectively to ionize the air at the focal point 22. The laser 12A may be a rasterizing laser, meaning the laser 12A sweeps across the atmosphere region 24 as described in more detail below. The laser 12A may also or alternatively be a femtosecond pulsed laser, a continuous laser, or any other suitable laser. The lasers 12A,B,C may be spaced apart from each other and cooperatively configured to transmit electromagnetic energy beams 20A,B,C to intersect at the focal point 22.

The motors 14A,B,C are substantially similar to each other so only motor 14A will be described in detail. The motor 14A may be drivably connected to the laser 12A such that the motor 14A is configured to rotate, pivot, and/or translate the laser 12A. In one embodiment, a plurality of motors are drivably connected to each laser 12A,B,C such that each laser 12A,B,C can be aimed across a range of azimuth and altitude angles.

The control system 16 may include a transceiver 26 and a controller 28. The control system 16 may also include processors, circuit boards, sensors, a memory 30, displays, inputs, and/or other electronic devices.

The transceiver 26 may receive incoming signals and other electromagnetic waves. The transceiver 26 also may outwardly transmit signals from the control system 16 or from electrical equipment related to the facility 18. The transceiver 26 may be or may include antennas, radio frequency (RF) transmitters, satellite dishes, and the like.

The controller 28 may implement aspects of the present invention with one or more computer programs stored in or on computer-readable medium residing on or accessible by the processor. Each computer program preferably comprises an ordered listing of executable instructions for implementing logical functions in the controller 28. Each computer program can be embodied in any non-transitory computer-readable medium, such as the memory described below, for use by or in connection with an instruction execution system, apparatus, or device, such as a computer-based system, processor-containing system, or other system that can fetch the instructions from the instruction execution system, apparatus, or device, and execute the instructions.

The memory 30 may be any computer-readable non-transitory medium that can store the program for use by or in connection with the instruction execution system, apparatus, or device. The computer-readable medium can be, for example, but not limited to, an electronic, magnetic, optical, electro-magnetic, infrared, or semi-conductor system, apparatus, or device. More specific, although not inclusive, examples of the computer-readable medium would include the following: an electrical connection having one or more wires, a portable computer diskette, a random access memory (RAM), a read-only memory (ROM), an erasable, programmable, read-only memory (EPROM or Flash memory), an optical fiber, and a portable compact disk read-only memory (CDROM).

Figure 3:
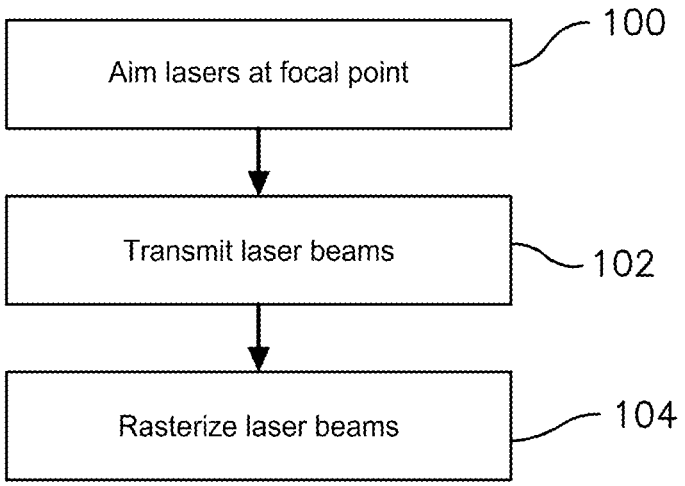
FIG. 3 is a flow diagram showing certain method steps for creating a plasma field Faraday cage in accordance with another embodiment of the invention.

Turning to FIG. 3, and with reference to FIGS. 1 and 2, use of the system 10 will now be described in more detail. First, the controller 28 may instruct the motors 14A,B,C to aim the lasers 12A,B,C at a first focal point 22 of a region 24 of atmosphere surrounding the facility 18, as shown in block 100. This may require the motors 14A,B,C to rotate or pivot the lasers 12A,B,C about several axes to achieve the correct azimuth angle and altitude angle.

The controller 28 may then instruct the lasers 12A,B,C to transmit electromagnetic energy beams 20A,B,C to the focal point 22 so that the electromagnetic energy beams 20A,B,C intersect at the focal point 22, as shown in block 102. To that end, the controller 28 may activate or energize the lasers 12A,B,C. Each electromagnetic energy beam 20A,B,C may individually have an amount of energy less than an amount of energy required to ionize air. For example, Each electromagnetic energy beam 20A,B,C may have 40% of the required energy to ionize air. However, electromagnetic energy beams 20A,B,C may cooperatively ionize the air at the focal point 22 via their combined energy. For example, the combined energy of the electromagnetic energy beams 20A,B,C may be 120% the required energy to ionize air.

The controller 28 may then instruct the motors 14A,B,C to move the lasers 12A,B,C so as to redirect the electromagnetic energy beams 20A,B,C to additional focal points over time, as shown in block 104. For example, the focal points may form a path 32 (line, arc, or pattern) in the atmosphere region 24. In this way, the lasers 12A,B,C may rasterize across the atmosphere region 24 to ionize air in an area 34 of the atmosphere region 24. The lasers 12A,B,C may be configured to ionize an area of the atmosphere region 24 while other lasers ionize another area of the atmosphere region.

The controller 28 may instruct the lasers 12A,B,C to transmit the electromagnetic energy beams 20 only when a predetermined condition is met. The predetermined condition may be a time of day, a duration of time, a threat level, a user command, or the like. In one embodiment, the controller 28 may instruct the lasers 12A,B,C to transmit the electromagnetic energy beams 20A,B,C when an unwanted signal is received via the transceiver 26. The plasma field Faraday cage thereby blocks further reception of the unwanted signal. The controller 28 may also instruct the lasers 12A,B,C to not transmit the electromagnetic energy beams 20A,B,C (or may not instruct the lasers 12A,B,C to transmit the electromagnetic energy beams 20A,B,C) when an electromagnetic signal is transmitted from the transceiver 26 or from the facility 18. Legitimate transmissions can be timed (e.g., pulsed) to coincide with downtimes of the lasers to effect essentially simultaneous signal transmission and atmosphere ionization.

The above-described system 10 provides several advantages. For example, the system 10 forms a plasma field Faraday cage around a structure, facility, electrical equipment, or the like without tremendous cost and material. The system 10 does not require a physical enclosure and physical ingress and egress into and out of the physical enclosure. The system 10 is dynamic and can accommodate many different sizes and shapes of equipment and structures within the Faraday cage.

Figure 4:
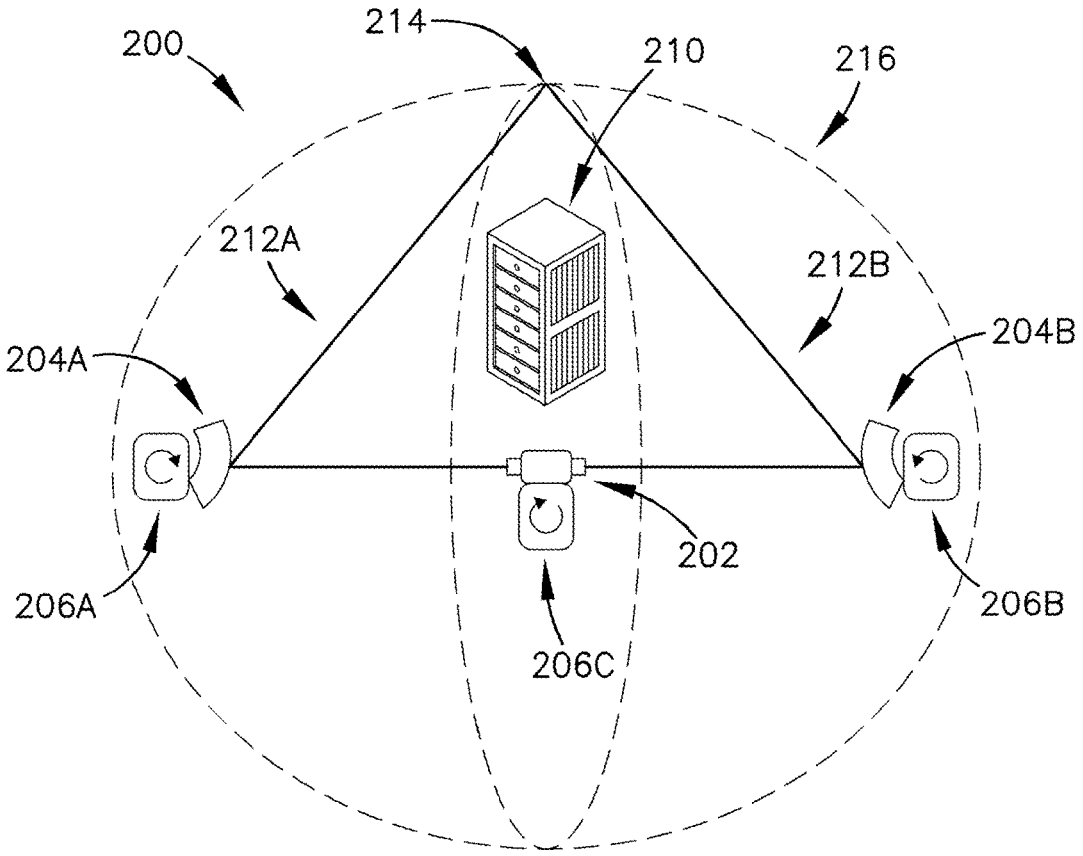
FIG. 4 is a perspective view of a plasma field Faraday cage system constructed in accordance with another embodiment of the invention.
Figure 5:
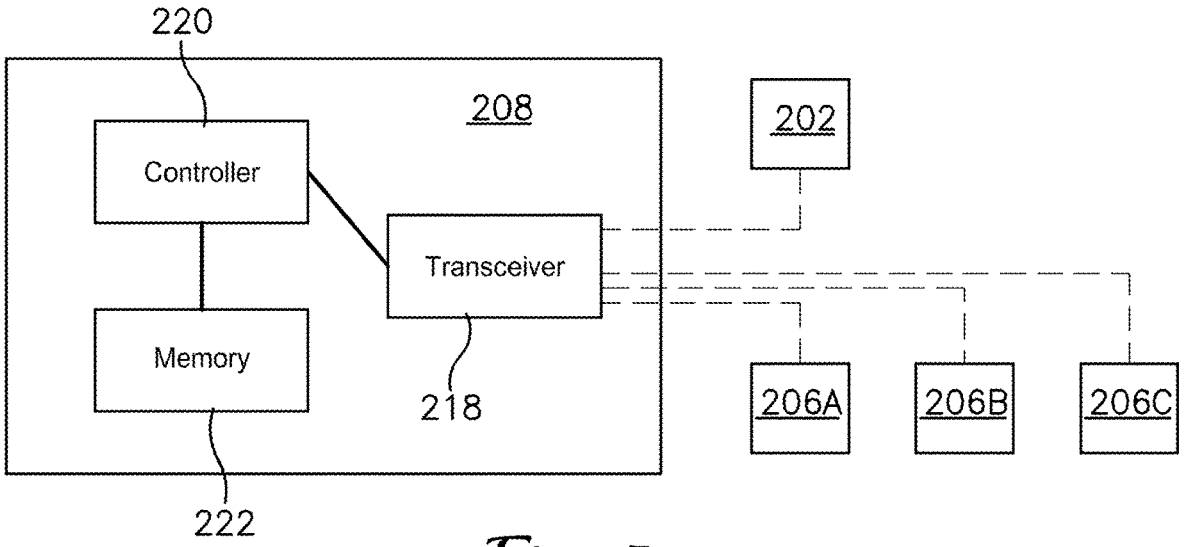
FIG. 5 is a schematic diagram of a control system of the plasma field Faraday cage system of FIG. 4.

Turning to FIGS. 4 and 5, a system 200 for creating a plasma field Faraday cage in accordance with another embodiment is illustrated. The system 200 broadly comprises a laser 202, a plurality of reflectors 204A,B, a plurality of motors 206A,B,C, and a control system 208. The system 200 may be used to block unwanted electromagnetic signals from reaching an electronic device, electrical equipment, a structure, a facility, or the like. The system 10 is shown protecting an electronic device 210.

The laser 202 may be configured to transmit a plurality of electromagnetic energy beams 212A,B to a focal point 214 of an air region 216 surrounding the electronic device 210 (e.g., a dome, a hemisphere, a spherical surface, or the like). The electromagnetic energy beams 212A,B may be portions of an initial electromagnetic energy beam divided by a beam splitter. Each electromagnetic energy beam 212A,B individually may have an amount of energy less than an amount of energy required to ionize air such that the electromagnetic energy beams 212A,B cannot ionize air individually. The electromagnetic energy beams 212A,B may have enough energy collectively to ionize the air at the focal point 214. The laser 202 may be a femtosecond pulsed laser, a continuous laser, or any other suitable laser.

The reflectors 204A,B are substantially similar so only reflector 204A will be described in detail. The reflector 204A redirects the electromagnetic energy beam 212A at an angle toward the focal point 214A. The reflector 204A may be a mirror or other reflective surface.

The motors 206A,B are substantially similar so only motor 206A will be described. The motor 206A may be drivably connected to the reflector 204A such that the motor 206A is configured to rotate, pivot, and/or translate the reflector 204A.

The motor 206C is drivably connected to a structure supporting the reflectors 204A,B and is configured to rotate, pivot, and/or translate the reflectors 204A,B.

The control system 208 may include a transceiver 218 and a controller 220. The control system 208 may also include processors, circuit boards, sensors, a memory 222, displays, inputs, and/or other electronic devices. The control system 208 may be substantially similar to the control system 16 described above and thus will not be described in more detail.

Figure 6:
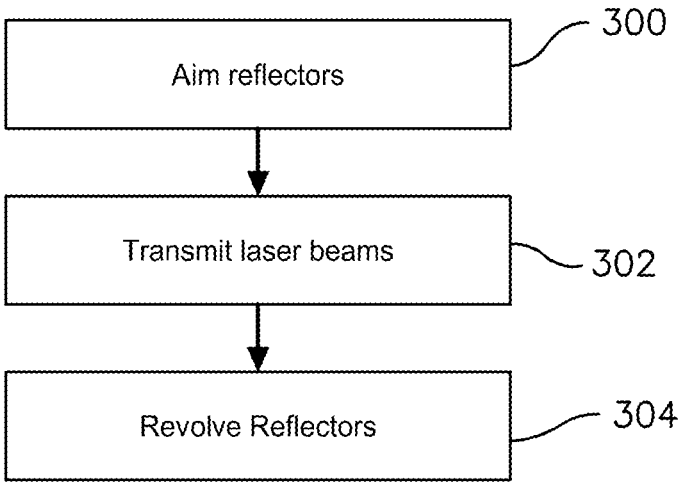
FIG. 6 is a flow diagram showing certain method steps for creating a plasma field Faraday cage in accordance with another embodiment of the invention.

Turning to FIG. 6 and with reference to FIGS. 4 and 5, use of the system 200 will now be described in more detail. First, the controller 220 may instruct the motors 206A,B,C to move the reflectors 204A,B to a specific reflective position, as shown in block 300. This may require the motors 206A,B,C to rotate or pivot the lasers reflectors 204A,B about several axes to achieve the correct reflection angles.

The controller 220 may then instruct the laser 202 to transmit electromagnetic energy beams 212A,B to the focal point 214 (via the reflectors 204A,B) so that the electromagnetic energy beams 212A,B intersect at the focal point, as shown in block 302. To that end, the controller 220 may activate or energize the laser 202. Each electromagnetic energy beam 212A,B may individually have an amount of energy less than an amount of energy required to ionize air. However, electromagnetic energy beams 212A,B may cooperatively ionize the air at the focal point 214 via their combined energy.

The controller 220 may then instruct the motors 206A,B to move the reflectors 204A,B so as to redirect the electromagnetic energy beams 212A,B to additional focal points over time, as shown in block 304. For example, the focal points may form a ring 222. The controller 220 may also instruct the motor 206C to move the reflectors 204A,B to effectively move the ring 222, thereby forming a spherical surface 224 of focal points.

The controller 220 may instruct the laser 202 to transmit the electromagnetic energy beams 212 only when a predetermined condition is met. The predetermined condition may be a time of day, a duration of time, a threat level, a user command, or the like. In one embodiment, the controller 220 may instruct the laser 202 to transmit the electromagnetic energy beams 212A,B when an unwanted signal is received via the transceiver 218. The plasma field Faraday cage thereby blocks further reception of the unwanted signal. The controller 220 may also instruct the laser 202 to not transmit the electromagnetic energy beams 212A,B (or may not instruct the laser 202 to transmit the electromagnetic energy beams 212A,B) when an electromagnetic signal is transmitted from the transceiver 218 or from the electronic device 210. Legitimate transmissions can be timed (e.g., pulsed) to coincide with downtimes of the lasers to effect essentially simultaneous signal transmission and air ionization.

Figure 7:
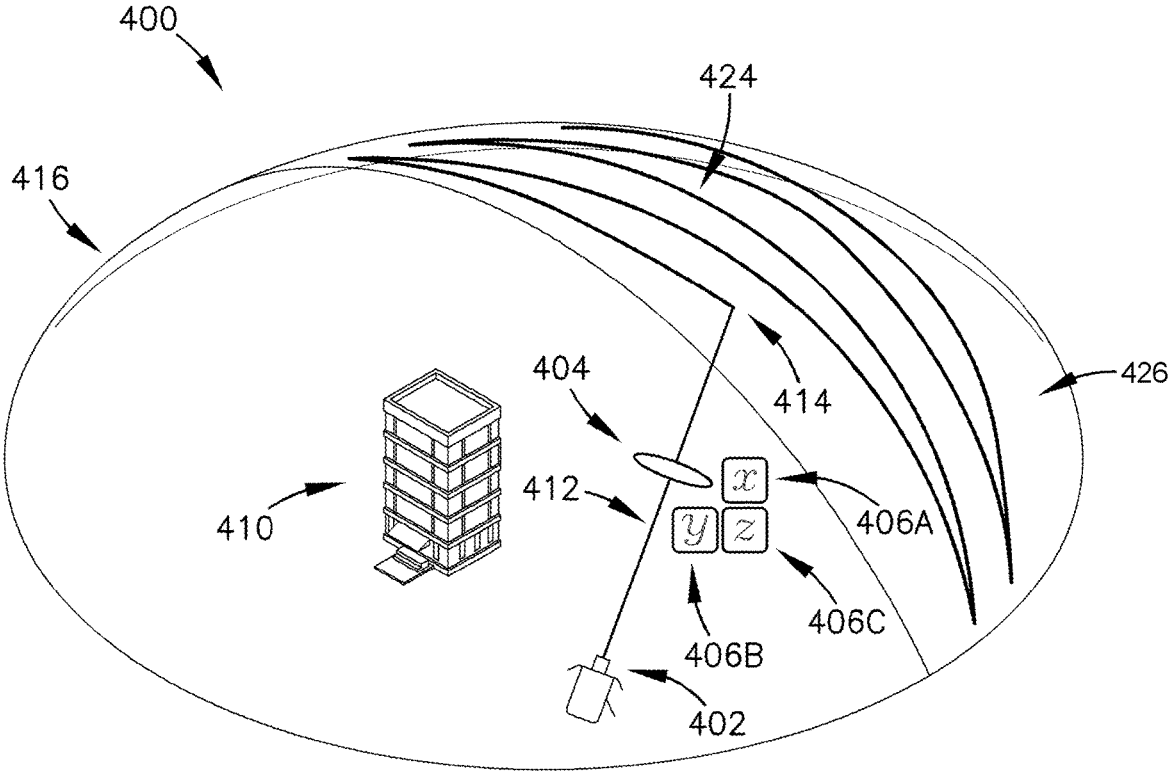
FIG. 7 is a perspective view of a plasma field Faraday cage system constructed in accordance with another embodiment of the invention.
Figure 8:
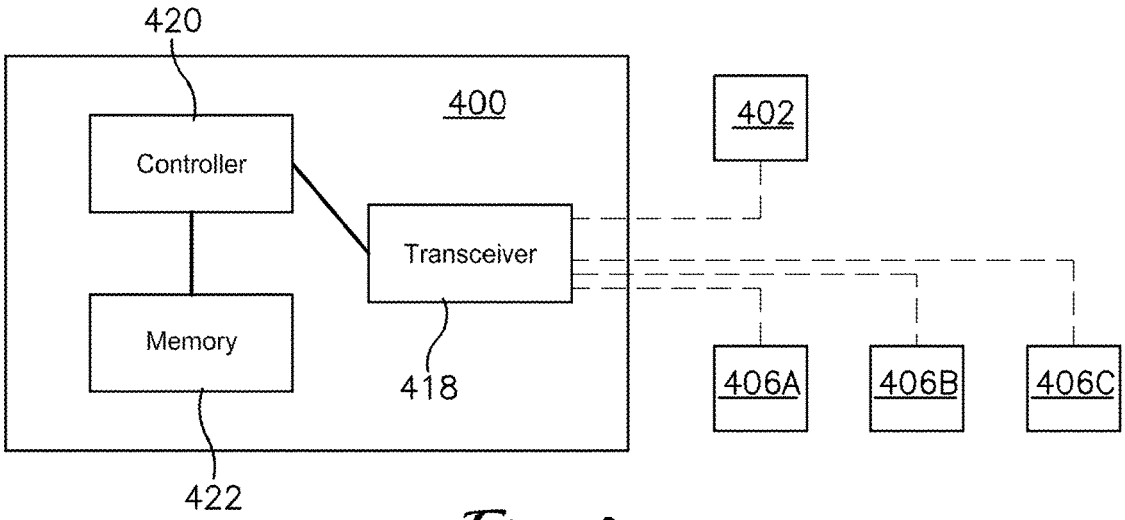
FIG. 8 is a schematic diagram of a control system of the plasma field Faraday cage system of FIG. 7.

Turning to FIGS. 7 and 8, a system 400 constructed in accordance with another embodiment is illustrated. The system 400 broadly comprises a laser 402, a lens 404, a plurality of motors 406A,B,C, and a control system 408. The system 400 may be used to block unwanted electromagnetic signals from reaching an electronic device, electrical equipment, a structure, a facility, or the like. The system 10 is shown protecting a facility 410.

The laser 402 may be configured to transmit an electromagnetic energy beam 412 through the lens 404 to a focal point 414 of an atmosphere region 416 (e.g., a dome, a hemisphere, a spherical surface, or the like). The electromagnetic energy beam 412 may be unfocused until it passes through the lens 404. The unfocused electromagnetic energy beam 412 may have an amount of energy (at any given point) less than an amount of energy required to ionize air such that the unfocused electromagnetic energy beam 412 cannot ionize air. The electromagnetic energy beam 412 may have enough energy when focused to ionize the air at the focal point 414. The laser 402 may be a femtosecond pulsed laser, a continuous laser, or any other suitable laser.

The lens 404 focuses the electromagnetic energy beam 412 at the focal points 414. The lens 404 may be a convex lens, a concave reflector, or the like.

The motors 406A,B,C are substantially similar so only motor 406A will be described. The motor 406A may be drivably connected to the lens 404 such that the motor 406A is configured to rotate, pivot, and/or translate the lens 404. In one embodiment, each motor 406A,B,C rotates the lens 404 about a different axis perpendicular to the other axes.

The control system 408 may include a transceiver 418 and a controller 420. The control system 408 may also include processors, circuit boards, sensors, a memory 422, displays, inputs, and/or other electronic devices. The control system 408 may be substantially similar to the control systems 16, 208 described above and thus will not be described in more detail.

Figure 9:
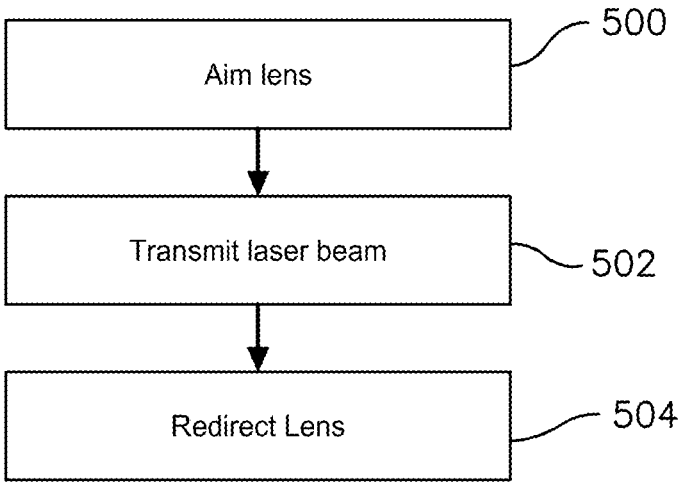
FIG. 9 is a flow diagram showing certain method steps for creating a plasma field Faraday cage in accordance with another embodiment of the invention.

Turning to FIG. 9, and with reference to FIGS. 7 and 8, use of the system 400 will now be described in more detail. First, the controller 420 may instruct the motors 406A,B,C to move the lens 404 to a specific refractive position, as shown in block 500. This may require the motors 406A,B,C to rotate or pivot the lens 404 about several axes to achieve the correct refractive angles.

The controller 420 may then instruct the laser 402 to transmit the electromagnetic beam 412 to the focal point 414 (via the lens 404) so that the electromagnetic energy beam 412 focuses at the focal point 414, as shown in block 502. To that end, the controller 420 may activate or energize the laser 402. The electromagnetic energy beam 412 may have an amount of energy (at any given point) less than an amount of energy required to ionize air. However, the focused electromagnetic energy beam 412 may ionize the air at the focal point 414.

The controller 420 may then instruct the motors 406A, B,C to move the lens 404 so as to redirect the electromagnetic energy beam 412 to additional focal points over time, as shown in block 504. For example, the focal points may form a path 424 (line, arc, or pattern) in the atmosphere region 416. In this way, the laser 402 may rasterize across the atmosphere region 416 to ionize air in an area 426 of the atmosphere region 416. The laser 402 may be configured to ionize an area of the atmosphere region 416 while other lasers ionize another area of the atmosphere region 416.

The controller 420 may instruct the laser 402 to transmit the electromagnetic energy beam 412 only when a predetermined condition is met. The predetermined condition may be a time of day, a duration of time, a threat level, a user command, or the like. In one embodiment, the controller 420 may instruct the laser 402 to transmit the electromagnetic energy beam 412 when an unwanted signal is received via the transceiver 418. The plasma field Faraday cage thereby blocks further reception of the unwanted signal. The controller 420 may also instruct the laser 402 to not transmit the electromagnetic energy beam 412 (or may not instruct the laser 402 to transmit the electromagnetic energy beam 412) when an electromagnetic signal is transmitted from the transceiver 418 or from the facility 410. Legitimate transmissions can be timed (e.g., pulsed) to coincide with downtimes of the lasers to effect essentially simultaneous signal transmission and atmosphere ionization.

Figure 10:
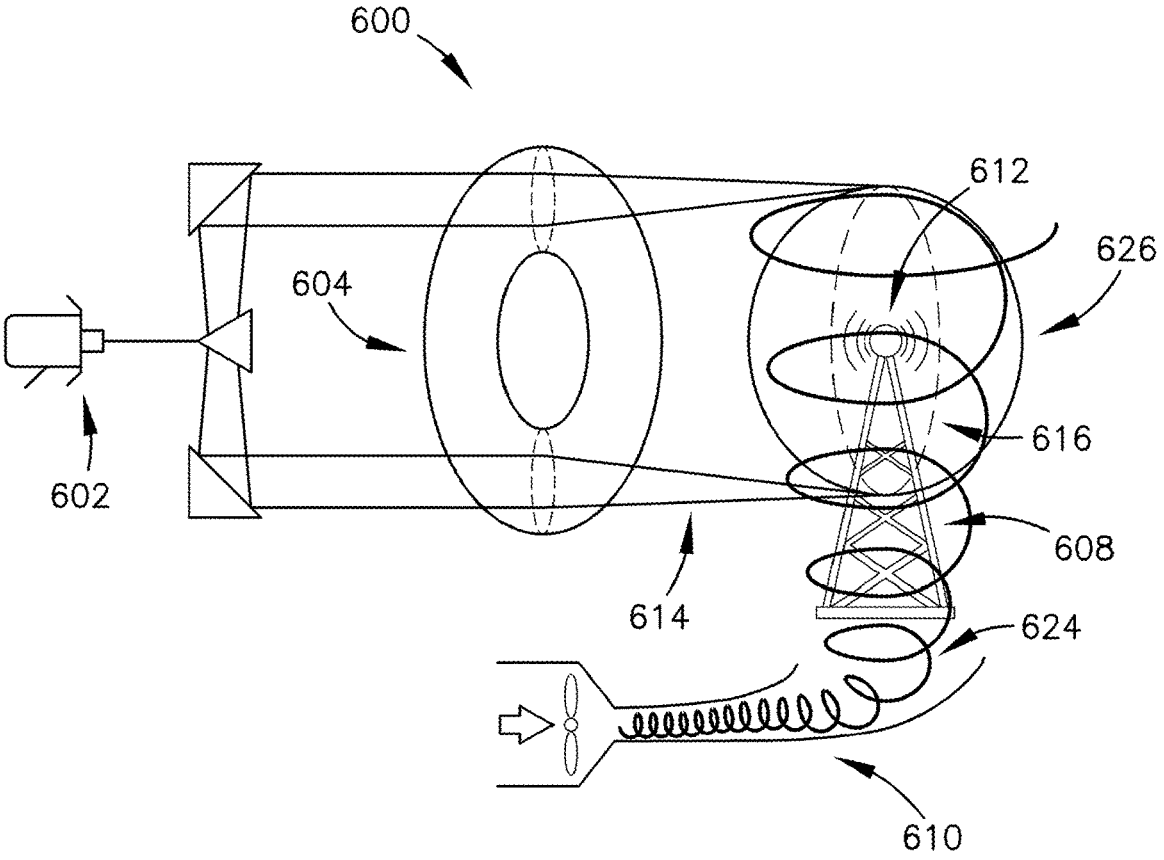
FIG. 10 is a perspective view of a plasma field Faraday cage system constructed in accordance with another embodiment of the invention.
Figure 11:
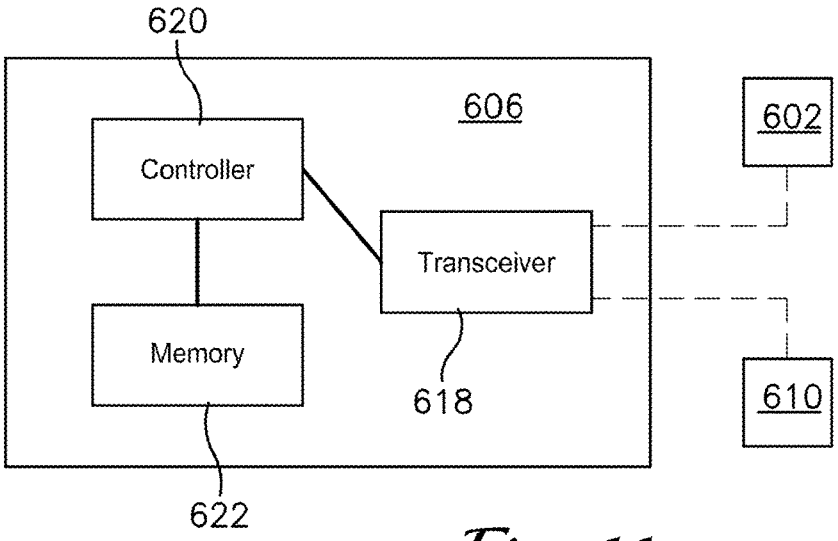
FIG. 11 is a schematic diagram of a control system of the plasma field Faraday cage system of FIG. 10.

Turning to FIGS. 10 and 11, a system 600 constructed in accordance with another embodiment is illustrated. The system 600 broadly comprises a laser 602, a lens 604, a control system 606, a support structure 608, and an airflow system 610. The system 600 may be used to block unwanted electromagnetic signals from reaching an electronic device, electrical equipment, a structure, a facility, or the like. The system 10 is shown protecting an electrical equipment 612.

The laser 602 may be configured to transmit an electromagnetic energy beam 614 toward the lens 604. The electromagnetic energy beam 614 may be unfocused until it is focused by the lens 604. The unfocused electromagnetic energy beam 614 may have an amount of energy (at any given point) less than an amount of energy required to ionize air such that the unfocused electromagnetic energy beam 614 cannot ionize air. The electromagnetic energy beam 614 may have enough energy when focused to ionize the air at a focal ring 616. The laser 602 may be a femtosecond pulsed laser, a continuous laser, or any other suitable laser.

The lens 604 focuses the electromagnetic energy beam 614 to the focal ring 616. To that end, the lens 604 may have a convex donut shape.

The control system 606 may include a transceiver 618 and a controller 620. The control system 606 may also include processors, circuit boards, sensors, a memory 622, displays, inputs, and/or other electronic devices. The control system 606 may be substantially similar to the control systems 16, 208, 408 described above and thus will not be described in more detail.

The support structure 608 positions the electrical equipment 612 within the atmosphere area to be ionized. The support structure 608 may be a tower, electric pole, antenna, or the like. To that point, the support structure 608 may elevate the electrical equipment 612 above a ground surface, a building, or other structure.

The airflow system 610 circulates air around the electrical equipment 612. The airflow system 610 may be a system of fans, a wind tunnel, an HVAC system, or the like.

Figure 12:
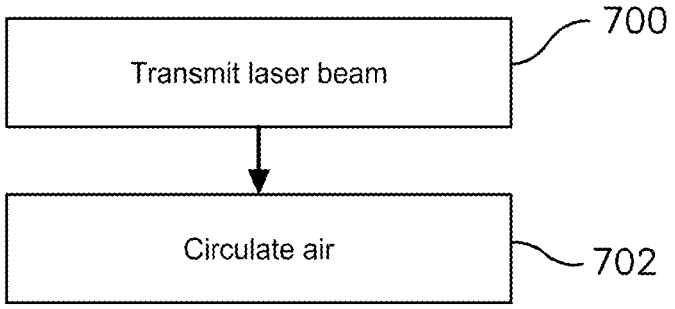
FIG. 12 is a flow diagram showing certain method steps for creating a plasma field Faraday cage in accordance with another embodiment of the invention.

Turning to FIG. 12, and with reference to FIGS. 10 and 11, use of the system 600 will now be described in more detail. First, the controller 620 may instruct the laser 602 to transmit the electromagnetic energy beam 614 toward and through the lens 604 so that the electromagnetic energy beam 614 focuses at the focal ring 616, as shown in block 700. To that end, the controller 620 may activate or energize the laser 602. The unfocused electromagnetic energy beam 614 may have an amount of energy (at any one point) less than an amount of energy required to ionize air. However, the electromagnetic energy beam 614 may ionize the air at the focal ring 616.

The controller 620 may then instruct the airflow system 610 to circulate air around the electrical equipment 612, as shown in block 702. The ionized air at the focal ring 616 thereby forms an ionized spherical surface 624, as shown in block 702.

The controller 620 may instruct the laser 602 to transmit the electromagnetic energy beam 614 only when a predetermined condition is met. The predetermined condition may be a time of day, a duration of time, a threat level, a user command, or the like. In one embodiment, the controller 620 may instruct the laser 602 to transmit the electromagnetic energy beam 614 when an unwanted signal is received at the electronic device. The plasma field Faraday cage thereby blocks further reception of the unwanted signal. The controller 620 may also instruct the laser 602 to not transmit the electromagnetic energy beam 614 (or may not instruct the laser 602 to transmit the electromagnetic energy beam 614 when an electromagnetic signal is transmitted from the electrical equipment 612. Legitimate transmissions can be timed (e.g., pulsed) to coincide with downtimes of the laser 602 to effect essentially simultaneous signal transmission and air ionization.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A system for creating a plasma field Faraday cage, the system comprising:

a plurality of lasers spaced apart from each other, each laser being configured to transmit an electromagnetic energy beam to a focal point of an atmosphere region, each electromagnetic energy beam having an amount of energy less than an amount of energy required to ionize air, the electromagnetic energy beams intersecting at the focal point such that the electromagnetic energy beams cooperatively ionize the air at the focal point to block electromagnetic radiation from passing through the focal point; and an electronic device support configured to be at least partially positioned within the plasma field Faraday cage.

2. The system of claim 1, further comprising a plurality of motors configured to move the plurality of lasers and a control system configured to instruct the plurality of motors to move the plurality of lasers to redirect the electromagnetic energy beams to intersect at a plurality of focal points of the atmosphere region over time to ionize the air at the plurality of focal points.

3. The system of claim 2, the control system being further configured to instruct the plurality of lasers to transmit the electromagnetic energy beams when a predetermined condition is met.

4. The system of claim 2, the control system being further configured to instruct the plurality of lasers to transmit the electromagnetic energy beams when an unwanted electromagnetic signal is received.

5. The system of claim 2, the control system being further configured to instruct the plurality of lasers to not transmit the electromagnetic energy beams when an electromagnetic signal is transmitted.

6. A system for creating a plasma field Faraday cage, the system comprising:

a laser configured to transmit a plurality of electromagnetic energy beams to an atmosphere region, each electromagnetic energy beam having an amount of energy less than an amount of energy required to ionize air;

a plurality of reflectors configured to redirect the plurality of electromagnetic energy beams to intersect at one of a plurality of focal points of the atmosphere region such that the electromagnetic energy beams cooperatively ionize air at the one of the plurality of focal point;

a plurality of motors configured to move the reflectors;

a control system configured to instruct the plurality of motors to move the reflectors so that the electromagnetic energy beams intersect at a plurality of focal points in the atmosphere region over time to ionize the air at the plurality of focal points to block electromagnetic radiation from passing through the plurality of focal points; and an electronic device support configured to be at least partially positioned within the plasma field Faraday cage.

7. The system of claim 6, wherein the plurality of motors include first and second motors configured to move the reflectors so that the electromagnetic energy beams intersect along a ring of focal points.

8. The system of claim 7, wherein the plurality of motors include a third motor configured to move the reflectors so that the electromagnetic energy beams intersect along a spherical surface of focal points.

9. The system of claim 6, the control system being further configured to instruct the plurality of lasers to transmit the electromagnetic energy beams when a predetermined condition is met.

10. The system of claim 6, the control system being further configured to instruct the plurality of lasers to transmit the electromagnetic energy beams when an unwanted electromagnetic signal is received.

11. The system of claim 6, the control system being further configured to instruct the plurality of lasers to not transmit the electromagnetic energy beams when an electromagnetic signal is transmitted.

12. A system for creating a plasma field Faraday cage, the system comprising:

a laser configured to transmit an electromagnetic energy beam to an atmosphere region;

a lens configured to focus the electromagnetic energy beam at one of a plurality of focal points of the atmosphere region such that the electromagnetic energy beam ionizes air at the focal point to block electromagnetic radiation from passing through the focal point;

a first motor configured to move the lens;

a control system configured to instruct the first motor to move the lens so that the electromagnetic energy beam is focused at a plurality of focal points of the atmosphere region over time to ionize the air at the plurality of focal points; and an electronic device support configured to be at least partially positioned within the plasma field Faraday cage.

13. The system of claim 12, further comprising a second motor and a third motor, the first motor being configured to rotate the lens about a first axis, the second motor being configured to rotate the lens about a second axis, the third motor being configured to rotate the lens about a third axis, the control system being configured to instruct the first motor, second motor, and third motor to move the lens so that the electromagnet energy beam rasterizes across an area of the atmosphere region.

14. The system of claim 12, the control system being further configured to instruct the laser to transmit the electromagnetic energy beam when a predetermined condition is met.

15. The system of claim 12, the control system being further configured to instruct the laser to transmit the electromagnetic energy beam when an unwanted electromagnetic signal is received.

16. The system of claim 12, the control system being further configured to instruct the laser to not transmit the electromagnetic energy beam when an electromagnetic signal is transmitted.

17. A system for creating a plasma field Faraday cage, the system comprising:

a laser configured to transmit an electromagnetic energy beam;

a lens configured to focus the electromagnetic energy beam at a plurality of focal points of an atmosphere region such that the electromagnetic energy beam ionizes air at the plurality of focal points to block electromagnetic radiation from passing through the plurality of focal points; and an electronic device support configured to be at least partially positioned within the plasma field Faraday cage.

18. The system of claim 17, the lens being donut shaped so that the electromagnetic energy beam forms a plasma ring.

19. The system of claim 18, further comprising an air-moving system configured to rotate the atmosphere including the ionized air so that the plasma ring forms a plasma sphere.

* * * * *